US006278373B1

(12) United States Patent
Jaurigue et al.

(10) Patent No.: US 6,278,373 B1
(45) Date of Patent: Aug. 21, 2001

(54) LASER INTRUSION SYSTEM FOR DETECTING MOTION IN A SWIMMING POOL

(76) Inventors: Anthony L. Jaurigue; Antonio Jaurigue, both of 4130 E. Rockledge Rd., Phoenix, AZ (US) 85044

( * ) Notice: Subject to any disclaimer, the term of this patent is extended or adjusted under 35 U.S.C. 154(b) by 0 days.

(21) Appl. No.: 09/506,558

(22) Filed: Feb. 18, 2000

(51) Int. Cl.[7] ..... G08B 23/00

(52) U.S. Cl. ..... 340/573.6; 340/573.1; 340/573.6; 340/541; 340/555; 340/556; 340/557

(58) Field of Search ..... 340/573, 573.1, 340/573.6, 556, 557, 540, 541, 539, 555

(56) References Cited

U.S. PATENT DOCUMENTS

D. 366,004 1/1996 Poliah .
3,623,057 * 11/1971 Hedin ..... 340/258 B
3,688,298 * 8/1972 Miller et al. ..... 340/258 B
3,825,916 7/1974 Steele et al. .
4,853,691 * 8/1989 Kolbatz ..... 340/566
4,910,498 * 3/1990 Feher ..... 340/556
5,023,593 * 6/1991 Brox ..... 340/522
5,063,288 * 11/1991 Hsu et al. ..... 250/221
5,144,285 9/1992 Gore .
5,424,717 * 6/1995 Platt et al. ..... 340/551

* cited by examiner

*Primary Examiner*—Jeffrey Hofsass
*Assistant Examiner*—Hung Nguyen

(57) ABSTRACT

A laser intrusion system for detecting motion in a swimming pool for detecting a person entering a swimming pool. The laser intrusion system for detecting motion in a swimming pool includes a swimming pool. The swimming pool has a peripheral wall. The peripheral wall has a top edge. A motion detection apparatus is mounted in the peripheral wall of the pool such that emitted light travels over water in the pool. The motion detection apparatus is operationally coupled to a power source and an alarm device. The alarm device is adapted to produce a sound.

3 Claims, 4 Drawing Sheets

LASER INTRUSION SYSTEM FOR DETECTING MOTION IN A SWIMMING POOL

BACKGROUND OF THE INVENTION

1. Field of the Invention

The present invention relates to motion detecting systems and more particularly pertains to a new laser intrusion system for detecting motion in a swimming pool for detecting a person entering a swimming pool.

2. Description of the Prior Art

The use of motion detecting systems is known in the prior art. More specifically, motion detecting systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,623,057; U.S. Pat. No. 5,023,593; U.S. Pat. No. 5,063,288; U.S. Pat. No. 3,825,916; U.S. Pat. No. 5,144,285; and U.S. Pat. No. 366,004.

While these devices fulfill their respective, particular objectives and requirements, the aforementioned patents do not disclose a new laser intrusion system for detecting motion in a swimming pool. The inventive device includes a swimming pool. The swimming pool has a peripheral wall. The peripheral wall has a top edge. A motion detection apparatus is mounted in the peripheral wall of the pool such that emitted light travels over water in the pool. The motion detection apparatus is operationally coupled to a power source and an alarm device. The alarm device is adapted to produce a sound.

In these respects, the laser intrusion system for detecting motion in a swimming pool according to the present invention substantially departs from the conventional concepts and designs of the prior art, and in so doing provides an apparatus primarily developed for the purpose of detecting a person entering a swimming pool.

SUMMARY OF THE INVENTION

In view of the foregoing disadvantages inherent in the known types of motion detecting systems now present in the prior art, the present invention provides a new laser intrusion system for detecting motion in a swimming pool construction wherein the same can be utilized for detecting a person entering a swimming pool.

The general purpose of the present invention, which will be described subsequently in greater detail, is to provide a new laser intrusion system for detecting motion in a swimming pool apparatus and method which has many of the advantages of the motion detecting systems mentioned heretofore and many novel features that result in a new laser intrusion system for detecting motion in a swimming pool which is not anticipated, rendered obvious, suggested, or even implied by any of the prior art motion detecting systems, either alone or in any combination thereof.

To attain this, the present invention generally comprises a swimming pool. The swimming pool has a peripheral wall. The peripheral wall has a top edge. A motion detection apparatus is mounted in the peripheral wall of the pool such that emitted light travels over water in the pool. The motion detection apparatus is operationally coupled to a power source and an alarm device. The alarm device is adapted to produce a sound.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new laser intrusion system for detecting motion in a swimming pool apparatus and method which has many of the advantages of the motion detecting systems mentioned heretofore and many novel features that result in a new laser intrusion system for detecting motion in a swimming pool which is not anticipated, rendered obvious, suggested, or even implied by any of the prior art motion detecting systems, either alone or in any combination thereof.

It is another object of the present invention to provide a new laser intrusion system for detecting motion in a swimming pool which may be easily and efficiently manufactured and marketed.

It is a further object of the present invention to provide a new laser intrusion system for detecting motion in a swimming pool which is of a durable and reliable construction.

An even further object of the present invention is to provide a new laser intrusion system for detecting motion in a swimming pool which is susceptible of a low cost of manufacture with regard to both materials and labor, and which accordingly is then susceptible of low prices of sale to the consuming public, thereby making such laser intrusion system for detecting motion in a swimming pool economically available to the buying public.

Still yet another object of the present invention is to provide a new laser intrusion system for detecting motion in a swimming pool which provides in the apparatuses and methods of the prior art some of the advantages thereof, while simultaneously overcoming some of the disadvantages normally associated therewith.

Still another object of the present invention is to provide a new laser intrusion system for detecting motion in a swimming pool for detecting a person entering a swimming pool.

Yet another object of the present invention is to provide a new laser intrusion system for detecting motion in a swimming pool which includes a swimming pool. The swimming pool has a peripheral wall. The peripheral wall has a top edge. A motion detection apparatus is mounted in the peripheral wall of the pool such that emitted light travels over water in the pool. The motion detection apparatus is operationally coupled to a power source and an alarm device. The alarm device is adapted to produce a sound.

Still yet another object of the present invention is to provide a new laser intrusion system for detecting motion in a swimming pool that uses a pair of alarms for alerting the owners of a swimming pool that a person has entered the pool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF TILE PREFERRED EMBODIMENT

Figure 1:
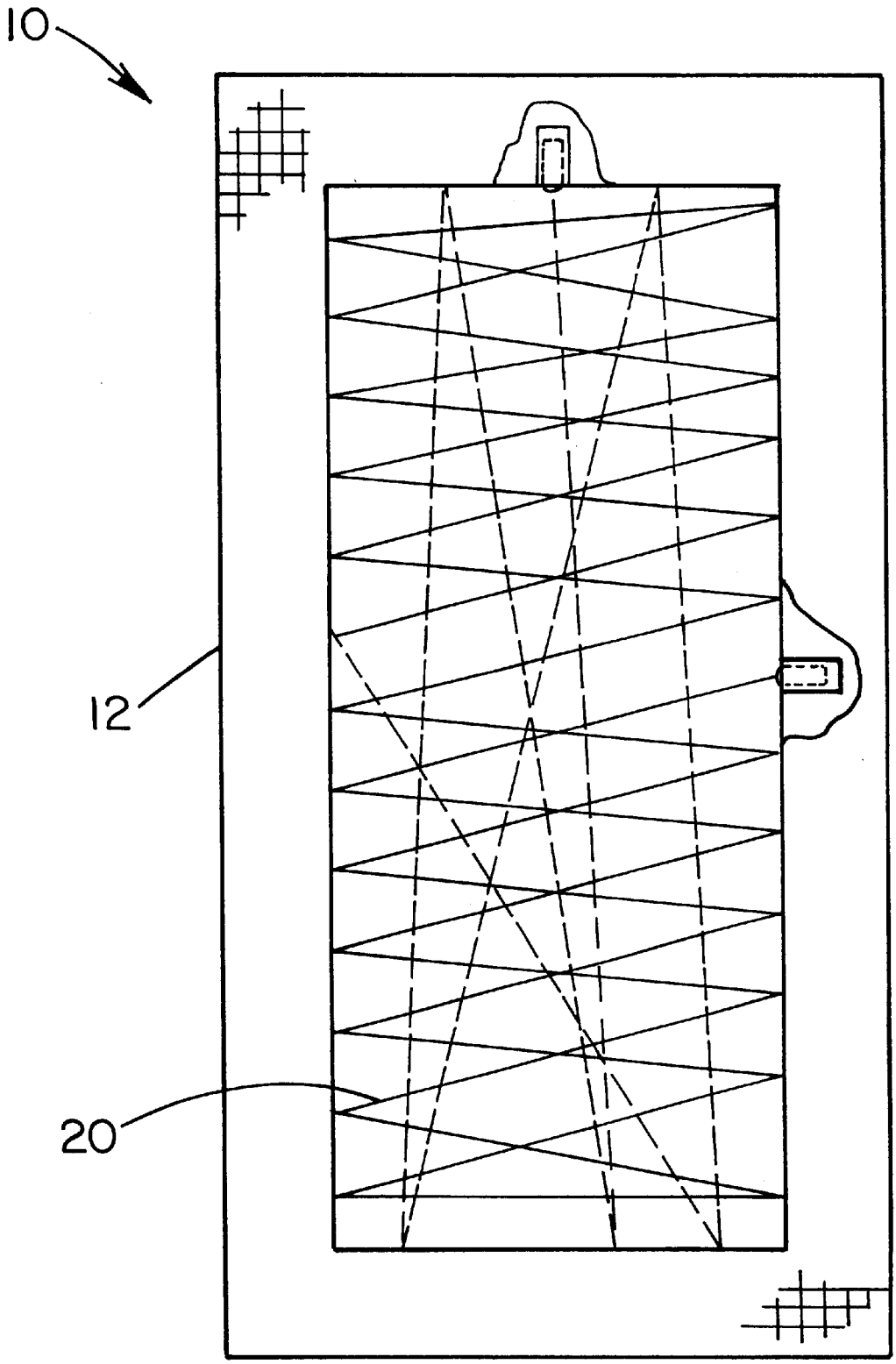
FIG. 1 is a schematic plan view of a new laser intrusion system for detecting motion in a swimming pool according to the present invention.

With reference now to the drawings, and in particular to FIGS. 1 through 6 thereof, a new laser intrusion system for detecting motion in a swimming pool embodying the principles and concepts of the present invention and generally designated by the reference numeral 10 will be described.

As best illustrated in FIGS. 1 through 6, the laser intrusion system for detecting motion in a swimming pool 10 generally comprises a pool 12. The pool 12 has a peripheral wall 14. The peripheral wall 14 has a top edge 16.

Figure 2:
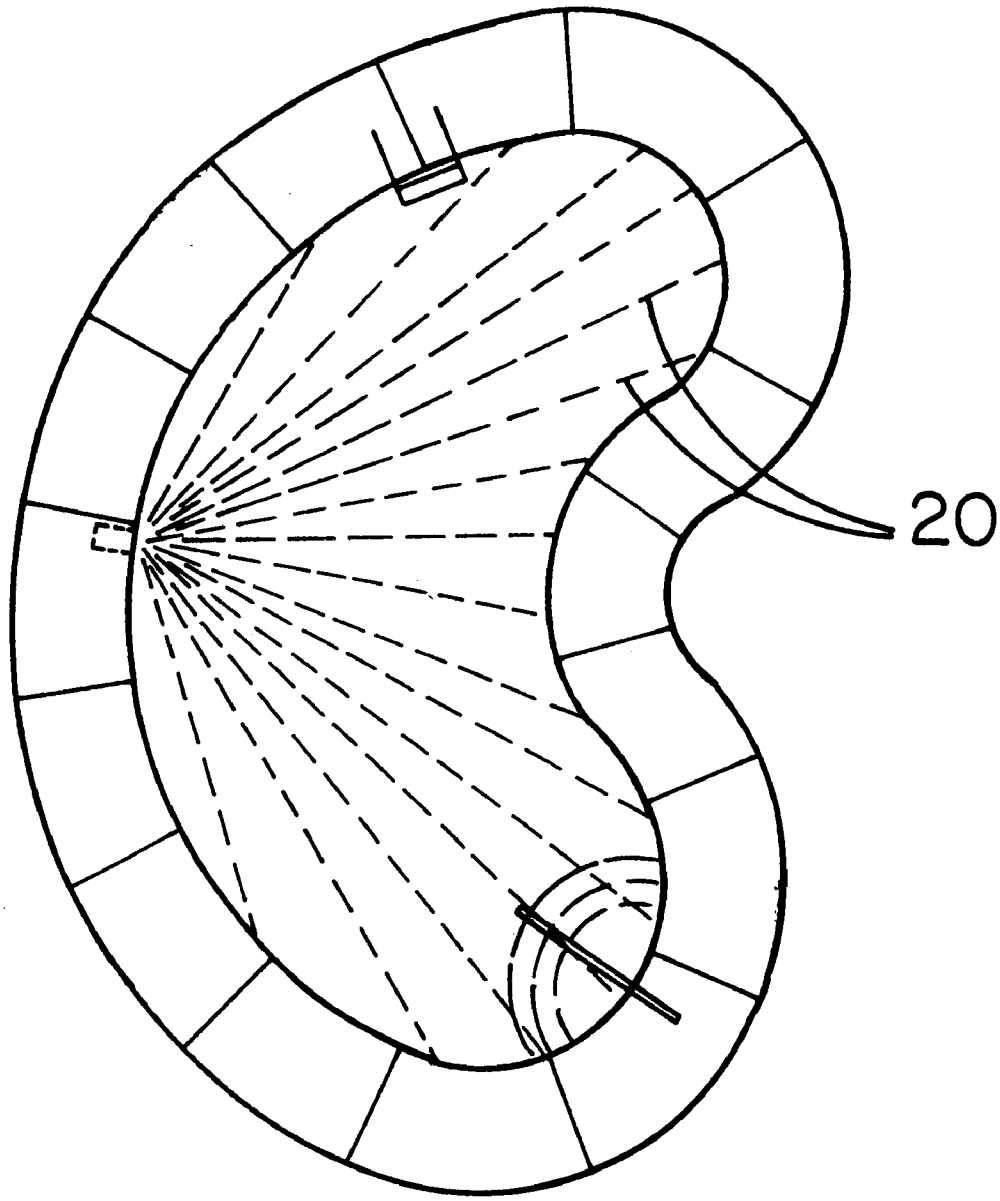
FIG. 2 is a schematic plan view of a second embodiment of the present invention.
Figure 3:
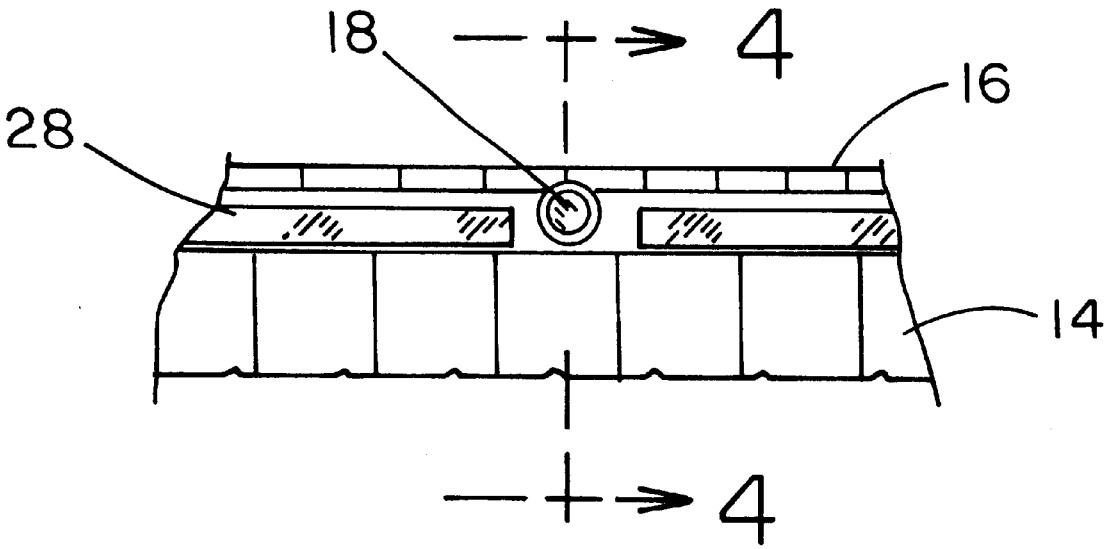
FIG. 3 is a schematic side view of the peripheral wall of the swimming pool the present invention.
Figure 4:
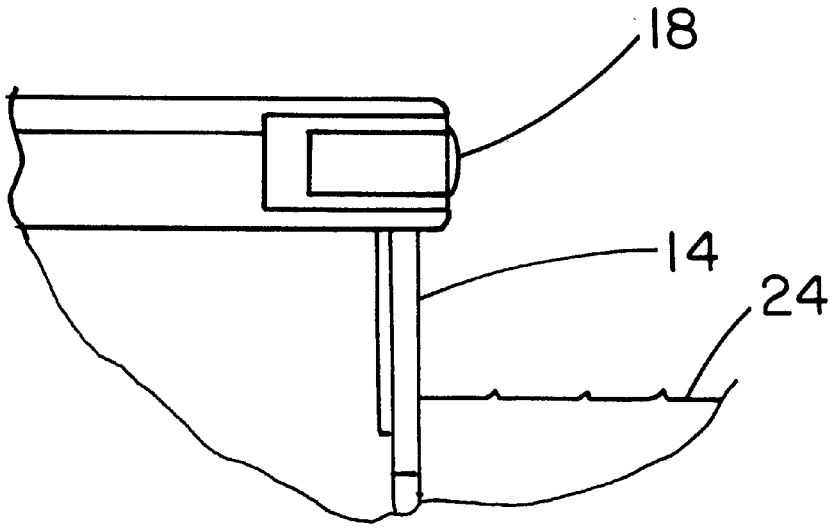
FIG. 4 is a schematic side view taken along line 4—4 of the present invention.
Figure 5:
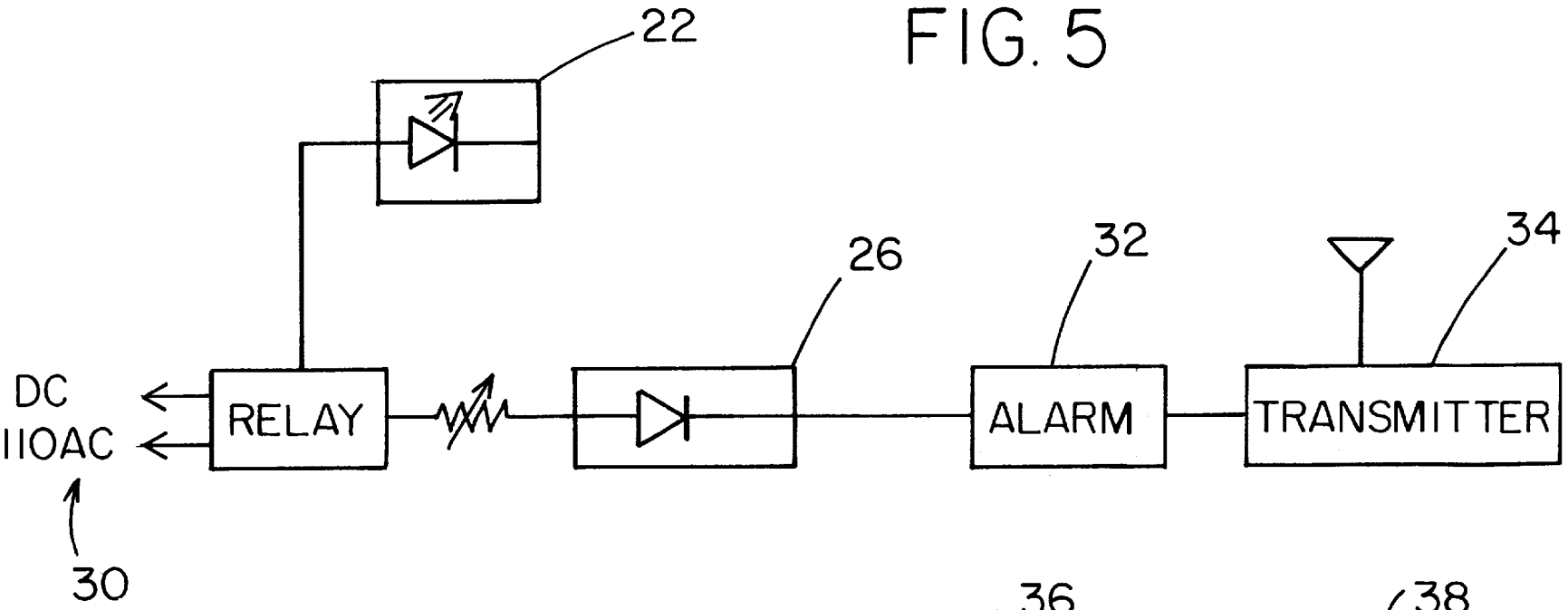
FIG. 5 is a schematic electronic view of the present invention.
Figure 6:
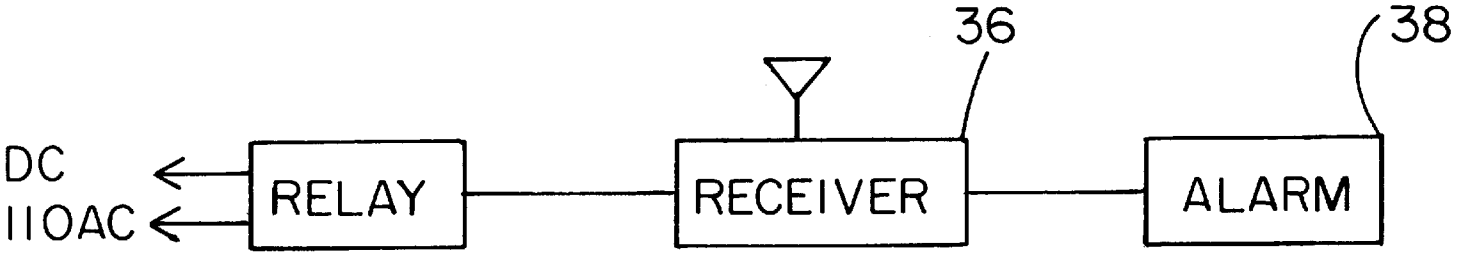
FIG. 6 is a schematic electronic view of the present invention.

A motion detection apparatus 18 includes a laser light emitting device 22 and a light detection device 26. The laser light emitting device 22 is mounted in the peripheral wall 14 of the pool 12. The laser light emitting device 22 is positioned generally adjacent to the top edge 16 of the peripheral wall such that emitted light 20 from the laser light emitting device 22 generally travels over the water 24 in the pool. The emitted light 20 travels in a plane, which is generally parallel with the surface of the water. The laser light emitting device 22 sends out pulses of the emitted light. The emitted light 20 preferably comprises infrared light. The light detecting device 26 is mounted in the laser light emitting device 22. The light detecting device 26 is operationally coupled to the laser light emitting device 22. The light detecting device 26 is adapted to time it takes the emitted light 20 pulses take to travel about the pool. The light detecting device 22 is adapted to detect infrared light. In general, the motion detection device is a conventional motion detection device. FIG. 1 demonstrates a steady laser beam which if broken will sound the alarm. FIG. 2 demonstrates pulses sent out which are timed. Lapses in time indicate movement in the pool.

A reflecting means 28 enhances reflecting of the emitted light 20 about the pool 12. The reflecting means 28 is fixedly mounted to the peripheral wall 14. The reflecting means 28 extends about the peripheral wall 14 and is generally positioned adjacent to the top edge 16 of the peripheral wall 14. The reflecting means 28 is preferably reflective tape, though mirrors may be utilized.

A power supply 30 is operationally coupled to the laser light emitting device 22 and the light detecting device 26.

A first alarm device 32 is operationally coupled to the light detecting device 26. The first alarm is adapted to produce a sound.

A transmitter 34 for transmitting a signal is operationally coupled to the first alarm 32. A receiver 36 is adapted for receiving a signal from the transmitter 34. The receiver 36 is operationally coupled to the power source 30.

A second alarm device 38 is operationally coupled to the receiver 36. The second alarm is adapted to produce a sound. Generally, the receiver 36 and second alarm device 38 are placed away from the pool in an area where the second alarm device 38 may be heard by persons away from the pool area.

In use, the motion detection apparatus 18 is turned on when the pool 12 is not in use. Should a person purposefully or accidentally enter the pool 12, the first 34 and second 38 alarm devices will sound to alert others that someone has entered the pool 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. laser intrusion detection system, said system comprising:

a pool having a peripheral wall, said peripheral wall having a top edge;

a motion detection apparatus being mounted on said peripheral wall of said pool, said motion detection apparatus being operationally coupled to a power source and an alarm device, said alarm device being adapted to produce a sound, said motion detecting apparatus comprising:

a laser light emitting device for sending out pulses of emitted light, said emitted light generally comprising infrared light, said emitted light being comprised of a focused beam such that said emitted light can travel a distance with negligible dispersion of said emitted light;

a light detecting device operationally coupled to said laser light emitting device, said light detecting device being adapted to time said emitted light after said emitted light travels about said pool, said light detecting device being adapted to detect infrared light; and a reflecting means for reflecting said emitted light about said pool, said reflecting means being fixedly mounted to said peripheral wall, said reflecting means extending about said peripheral wall, said reflecting means being generally positioned adjacent to said top edge of said peripheral wall.

2. The laser intrusion detection system as in claim 1, further comprising:

a transmitter for transmitting a signal, said transmitter being operationally coupled to said alarm device;

a receiver, said receiver being adapted for receiving a signal from said transmitter, said receiver being operationally coupled to said power source;

a second alarm device, said second alarm device being operationally coupled to said receiver, said second alarm device being adapted to produce a sound.

3. A laser intrusion detection system, said system comprising:

a pool, said pool having a peripheral wall, said peripheral wall having a top edge;

a laser motion apparatus, said apparatus comprising:

a laser light emitting device, said laser light emitting device being mounted in said peripheral wall of said pool, said laser light emitting device being positioned generally adjacent to said top edge of said peripheral wall such that emitted light from said laser light emitting device generally travels over the water in said pool, said laser light emitting device sending out pulses of said emitted light, said emitted light generally comprising infrared light, said emitted light comprising a focused beam such that said emitted light can travel a distance with negligible dispersion of said emitted light;

a light detecting device, said light detecting device being mounted in said laser light emitting device, said light detecting device being operationally coupled to said laser light emitting device, said light detecting device being adapted to time said emitted light after said emitted travels about said pool, said light detecting device being adapted to detect infrared light;

a reflecting means for reflecting said emitted light about said pool, said reflecting means being fixedly mounted to said peripheral wall, said reflecting means extending about said peripheral wall, said reflecting means being generally positioned adjacent to said top edge of said peripheral wall, said reflecting means being reflective tape;

a power supply, said power supply being operationally coupled to said laser light emitting device and said light detecting device;

a first alarm device, said alarm device being operationally coupled to said light detecting device, said first alarm being adapted to produce a sound;

a transmitter for transmitting a signal, said transmitter being operationally coupled to said first alarm;

a receiver, said receiver being adapted for receiving a signal from said transmitter, said receiver being operationally coupled to said power source;

a second alarm device, said second alarm device being operationally coupled to said receiver, said second alarm device being adapted to produce a sound.

* * * * *